US006457492B1

(12) United States Patent
Kuhn et al.

(10) Patent No.: US 6,457,492 B1
(45) Date of Patent: Oct. 1, 2002

(54) SEMI-AUTOMATIC CABLE TIE APPLICATION TOOL

(75) Inventors: Roger Kuhn, Memphis, TN (US); Wasim Khokhar, Cordova, TN (US); James D. Perrin, Memphis, TN (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/915,744

(22) Filed: Jul. 26, 2001

Related U.S. Application Data

(60) Provisional application No. 60/220,763, filed on Jul. 26, 2000.

(51) Int. Cl.[7] ..... B21F 9/00

(52) U.S. Cl. ..... 140/123.6; 140/93.2

(58) Field of Search ..... 140/93 A, 93.2, 140/123.6

(56) References Cited

U.S. PATENT DOCUMENTS 5,630,450 A * 5/1997 Kurmis et al. ..... 140/93.2
5,769,133 A * 6/1998 Dyer et al. ..... 140/123.6

* cited by examiner

*Primary Examiner*—Lowell A. Larson
(74) *Attorney, Agent, or Firm*—Hoffmann & Baron, LLP

(57) ABSTRACT

A semi-automatic cable tie application tool including a power-actuated cylinder located within the grip portion of the housing and including a flexible cable extending between the piston rod of the cylinder and the tensioning/cutting mechanisms of the tool. The tool includes first and second pulleys for movably supporting and orienting the direction of travel of the cable.

10 Claims, 4 Drawing Sheets

SEMI-AUTOMATIC CABLE TIE APPLICATION TOOL

This application claims the benefit of U.S. provisional Application No. 60/220,763 filed on Jul. 26, 2000.

BACKGROUND OF INVENTION

The present invention relates to a cable tie installation tool and, more particularly, to an improved semi-automatic tool for tensioning and cutting of cable ties.

As is well known to those skilled in the art, cable ties (or straps) are used to bundle or secure a group of articles such as electrical wires or cables. Cable ties of conventional construction include a cable tie head and an elongate tail extending therefrom. The tail is wrapped around a bundle of articles and thereafter inserted through a passage in the head. The head of the cable tie typically supports a locking element which extends into the head passage and engages the body of the tail to secure the tail to the head.

In practice, the installer manually places the tie about the articles to be bundled, inserts the tail through the head passage and then manually tightens the tie about the bundle. At this point, a cable tie installation tool is used to tension the cable tie to a predetermined tension.

Prior art tools include both manually-actuated tools and power-assisted tools. As will be appreciated by those skilled in the art, manually-actuated tools are operated as a result of the installer physically squeezing a trigger mechanism, while power-assisted tools are typically operated by via a pneumatic cylinder/piston. With respect to such prior art power-assisted tools, this pneumatic cylinder/piston is located horizontally above the handle of the tool, and in-line with the actuating rod of such tool. However, the placement of the pneumatic cylinder/piston above the operator's hand results in an unbalanced weight distribution throughout the tool, which makes the tool more difficult to handle and leads to increased operator fatigue.

There is therefore a need in the art for a semi-automatic cable tie application tool which is both ergonomical and user friendly. There is a further need in the art for a semi-automatic cable tie application tool having reduced weight, and which is reliable, compact and readily manufactured.

SUMMARY OF THE INVENTION

The present invention, which addresses the needs of the prior art, relates to a tool for installation of a cable tie. The cable tie includes a head and an elongate tail extending therefrom. The tool includes a generally pistol-shaped housing having a barrel portion and a grip portion. The housing operatively supports a tensioning mechanism for tensioning the cable tie to a predetermined tension setting and a cutting mechanism for severing an excess portion of the tail from the tensioned cable tie. The tool further includes a power-actuated cylinder having a movable piston rod for operating the tensioning and cutting mechanisms. The cylinder is located within the grip portion and is generally aligned therewith. Finally, the tool includes a drive train for coupling the piston rod to the tensioning and cutting mechanisms whereby movement of the piston rod operates the tensioning and cutting mechanism.

As a result, the present invention provides an ergonomically improved-power assisted tool having reduced weight and better handling characteristics. Moreover, the present invention provides a power assisted tool which maintains the fast cycle aspects of certain prior art power-assisted tools, but incorporates improved tensioning/cutoff mechanism technology.

DETAILED DESCRIPTION OF THE INVENTION

Figure 1:
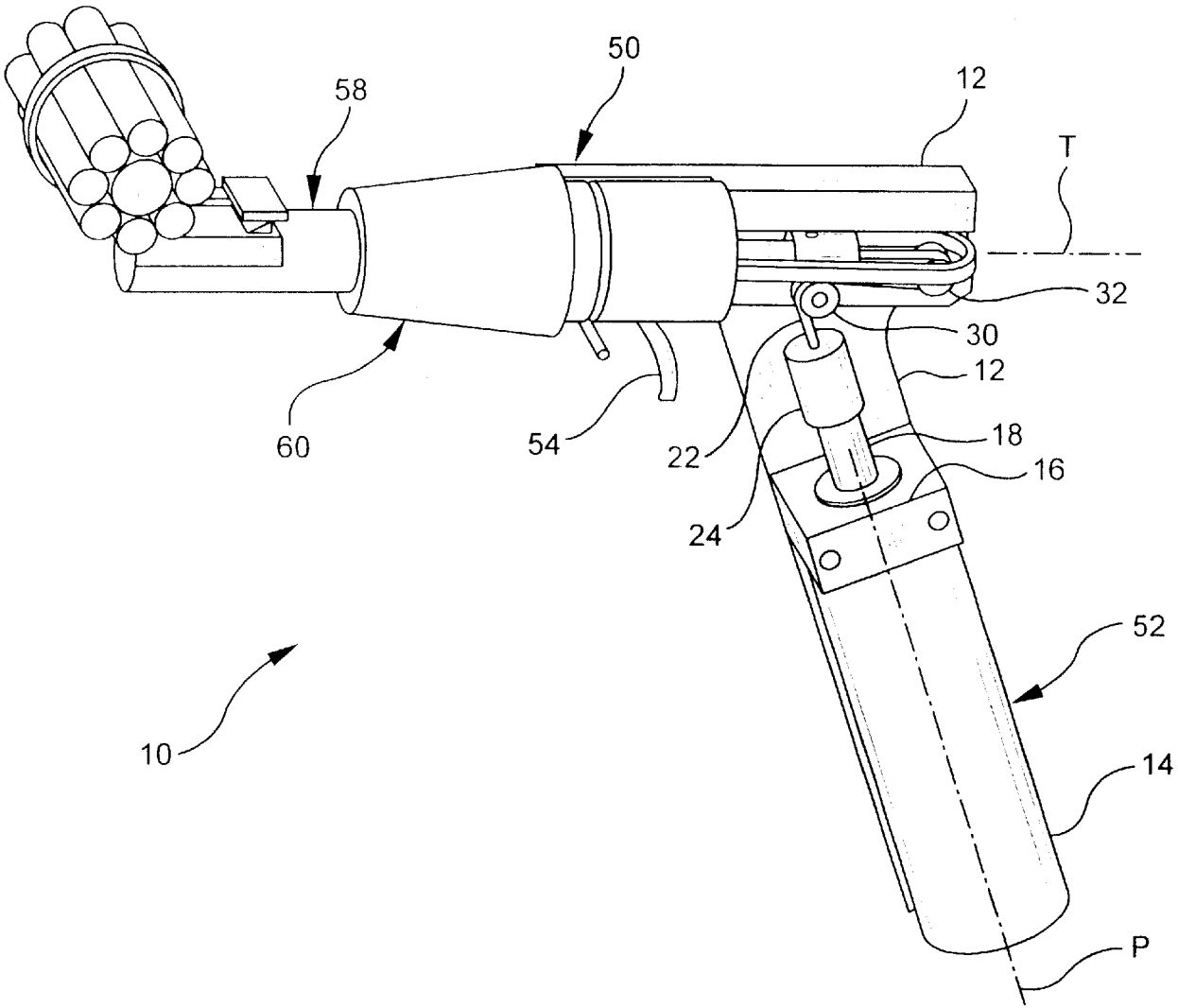
FIG. 1 is a perspective view of the semi-automatic cable tie application tool of the present invention with a portion of the housing removed for clarity.
Figure 2:
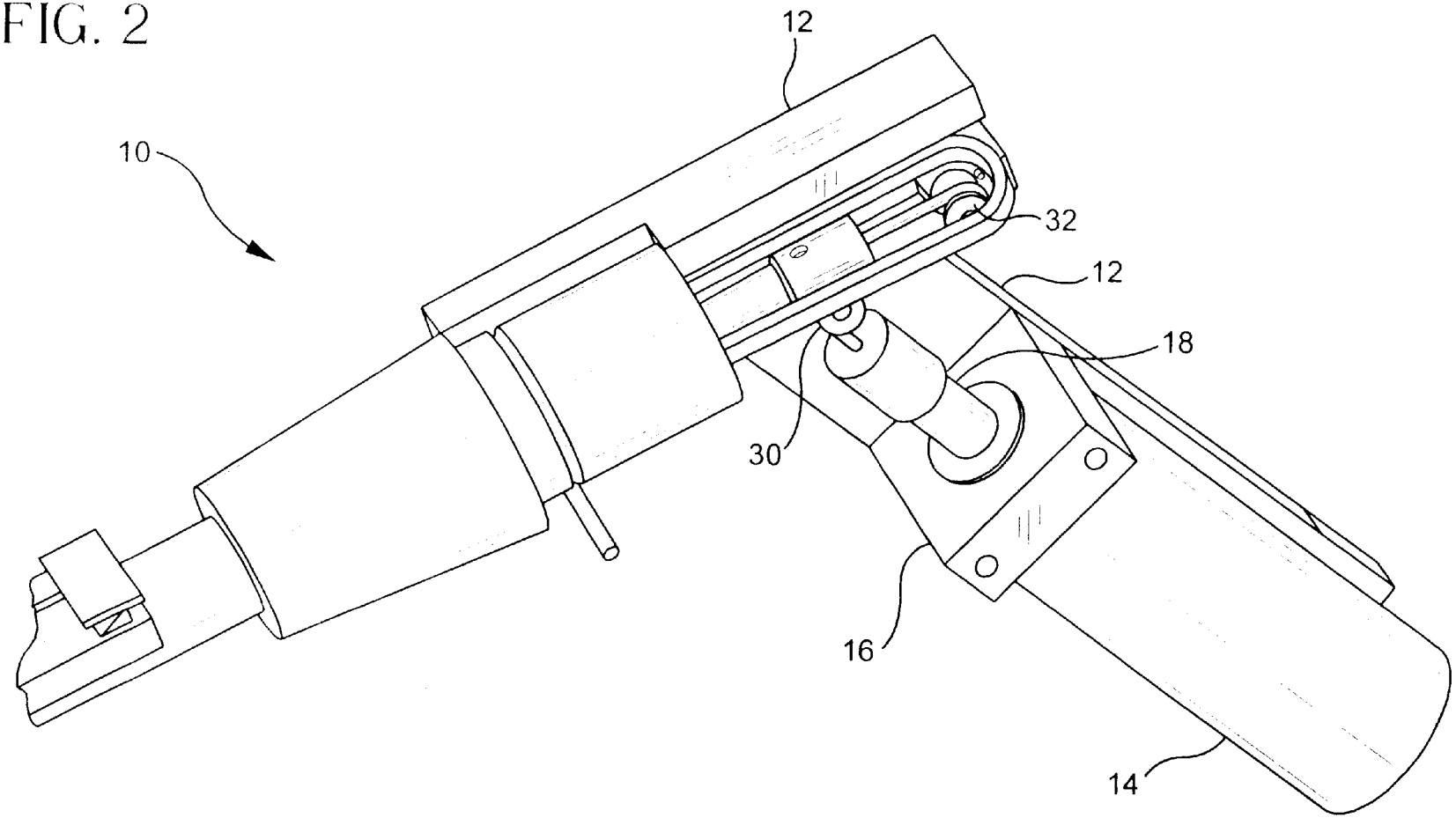
FIG. 2 is an enlarged view of the tool of FIG. 1.
Figure 3:
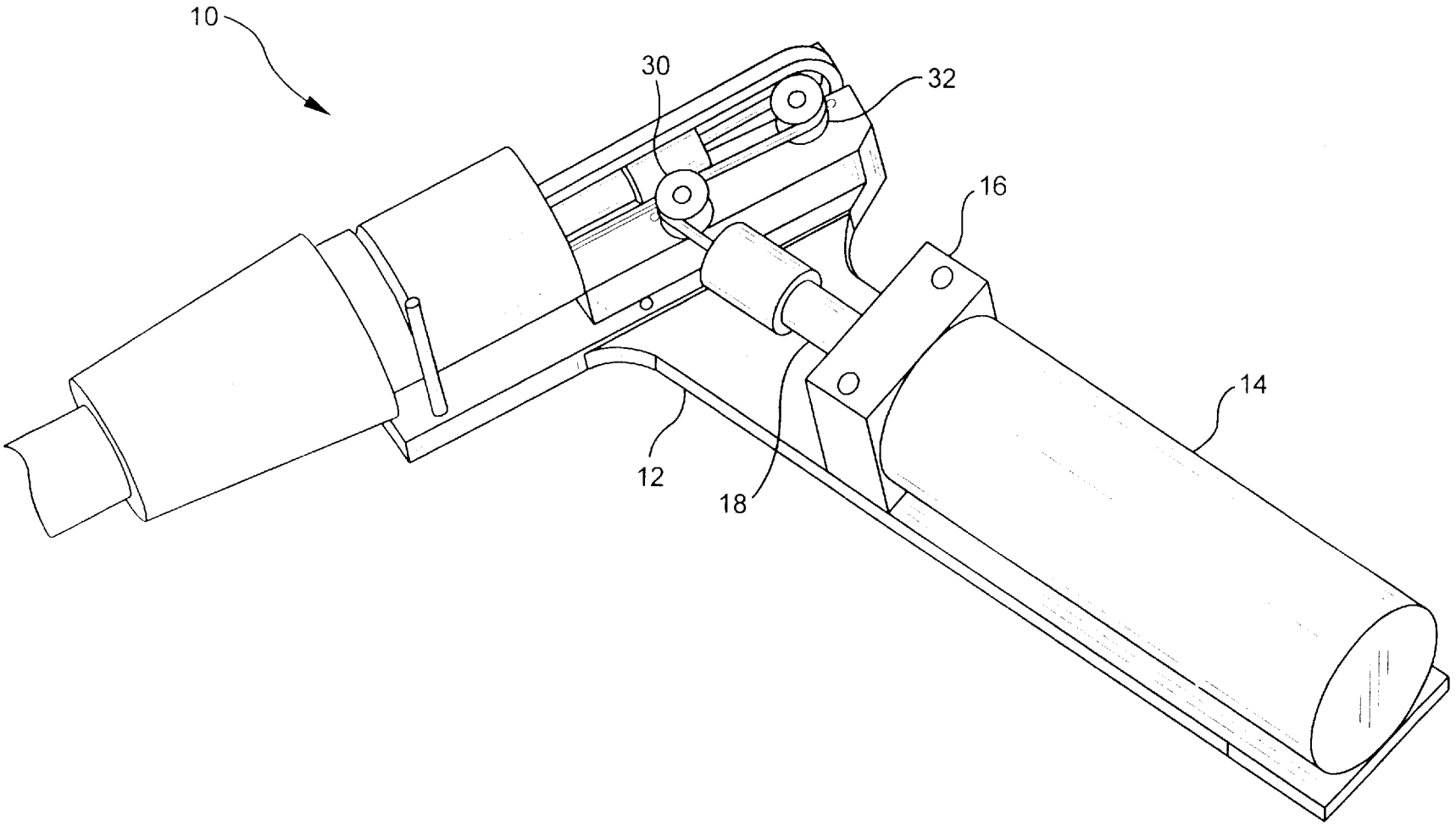
FIG. 3 is another enlarged view of the tool of FIG. 1.
Figure 4:
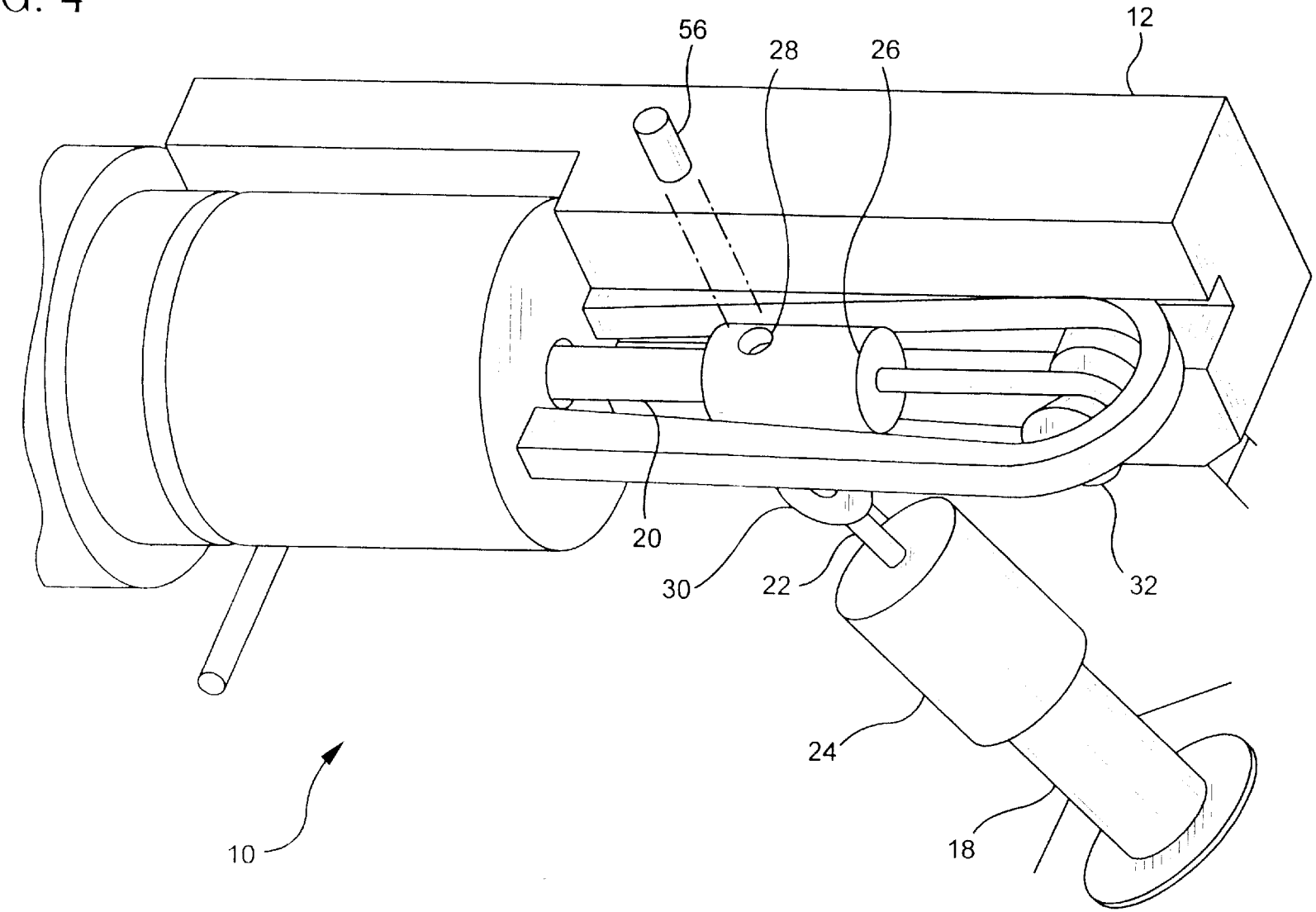
FIG. 4 is still another enlarged view of the tool of FIG. 1.

The present tool provides an ergonomical and user friendly semi-automatic cable tie application tool capable of applying 18 to 120 lb. ties of any length. Referring now to the drawings, a semi-automatic cable tie application tool 10 in accordance with the present invention is shown in FIGS. 1–4. Tool 10 includes a pistol-shaped housing 12 (a portion of which has been removed for clarity). In turn, housing 12 includes a barrel portion 50 and a grip portion 52.

As shown, tool 10 includes a pneumatic cylinder 14 located within the grip portion 52 of the tool. Cylinder 14 may be secured within the grip portion via a mounting block 16, or in any other convenient fashion. As mentioned, the location of the cylinder within the grip portion of the tool creates a more balanced weight distribution, thereby improving the handling ease and ergonomics of the tool. A source of compressed air (not shown) is connected to cylinder 14 and is operated via a trigger-actuated valve (not shown). In this manner, actuation of trigger 54 by an operator causes compressed air (a typical pressure is 85 psi) to be directed to cylinder 16 (which may be a single acting, spring extended type design).

As shown, the piston rod, i.e., piston rod 18, extending from the cylinder is directed upwards towards the barrel of the tool along an axis P. As a result, piston rod 18 is angularly oriented with respect to actuating rod 20 (best shown in FIG. 4). Because the actuating rod must be actuated in a horizontal direction (in a direction extending along the length of the barrel defined by axis T), a pulley/cable system is employed to couple piston rod 18 to actuating rod 20.

More particularly, this cable system includes a cable 22 having a threaded connecting cap 24 secured at one end. Cap 24 is sized to be threaded onto the end of piston rod 18. Of course, other means of connecting cap 24 to piston rod 18 are contemplated herein. A second connecting cap 26 is located at the other end of cable 22. Connecting cap 26 is preferably connected to actuating rod 20 via a pin 56 which extends through an aperture 28 formed in cap 26 and through a corresponding aperture formed in actuating rod 20. Again, cap 26 can be coupled to rod 20 in other manners. The cable/pulley assembly further includes a pair of pulleys 30, 32 which serve to redirect the movement of piston rod 18 (along axis P) into movement in-line with actuating rod 20 (along axis T). Particularly, pulley 30 is located directly in front of piston rod 18 to maintain alignment of the cable with the piston rod, while pulley 32 is located directly in-line with actuating rod 20.

It is contemplated herein that the present tool will utilize a polymer in frame construction (as opposed to prior art tools utilizing a 380-T6 aluminum construction). This polymer in frame construction can produce a weight saving of approximately 0.24 lbs. for a total weight of 0.96 lbs. (as compared to a comparable prior art tool formed of 380-T6 aluminum and weighing 1.2 lbs).

The tensioning/cutoff mechanism of tool 10 is described in detail in commonly owned U.S. Pat. No. 5,915,425, the disclosure of which is incorporated herein by reference. In this regard, tool 10 preferably includes a nose portion 58 which provides angular adjustability to facilitate installation of cable ties in a variety of orientations with respect to the installer's workstation. Tool 10 also preferably includes an adjustable tensioning mechanism 60 which provides rapid adjustability of the tension setting level, allows the installer to readily view the tension setting level and provides an adjustable tension setting mechanism which resists damage due to impact/jarring of the tool and exposure to dirt and other environmental conditions. Finally, the tensioning/cutoff mechanism of tool 10 preferably reduces and/or eliminates recoil shock/vibration during severing of the cable tie tail from the installed cable tie.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included within the scope of the following claims.

What is claimed is:

1. A tool for installation of a cable tie, said cable tie including a head and an elongate tail extending therefrom, said tool comprising:

a generally pistol-shaped housing having a barrel portion and a grip portion, said housing operatively supporting a tensioning mechanism for tensioning said cable tie to a predetermined tension setting and a cutting mechanism for severing an excess portion of said tail from said tensioned cable tie;

a power-actuated cylinder having a movable piston rod for operating said tensioning and cutting mechanisms, said cylinder being located within said grip portion and being generally aligned therewith;

a drive train for coupling said piston rod to said tensioning and cutting mechanisms whereby movement of said piston rod operates said tensioning and cutting mechanisms.

2. The tool according to claim 1, wherein said drive train includes a flexible cable for coupling said piston rod to said tensioning and cutting mechanisms.

3. The tool according to claim 2, further comprising:

first and second pulleys, said first pulley being located substantially in-line with said piston rod whereby a first portion of said cable extending between said piston rod and said first pulley is substantially co-axially aligned with said piston, and wherein said second pulley is located substantially in-line with said tensioning and cutting mechanisms whereby a second portion of said cable extending between said second pulley and said mechanisms is substantially co-axially aligned with said mechanisms.

4. The tool according to claim 3, further comprising:

an actuating rod extending along said barrel portion of said handle for operating said tensioning and cutting mechanisms, said actuating rod including a first end positioned proximate said grip portion of said housing;

a first connecting cap connected to said piston rod;

a second connecting cap connected to said first end of said actuating rod; and wherein said cable extends between said first and second connecting caps and is movably supported by said first and second pulleys.

5. The tool according to claim 4, wherein said first connecting cap is configured for threading engagement with said piston rod.

6. The tool according to claim 4, further comprising a pin for coupling said second connecting cap to said first end of said actuating rod.

7. The tool according to claim 1, wherein said housing comprises a polymer in frame construction.

8. The tool according to claim 1, wherein said power-actuated cylinder includes a pneumatic cylinder.

9. The tool according to claim 8, further comprising a mounting block located within said grip portion of said housing, said block being configured to fixedly support said cylinder within said grip portion.

10. The tool according to claim 8, further comprising a trigger operatively connected to said cylinder, said trigger being movably mounted to said housing.

* * * * *